US005301534A

United States Patent [19]

Nishikawa et al.

[11] Patent Number: 5,301,534

[45] Date of Patent: Apr. 12, 1994

[54] MULTIPLE LANE IRONING AND DOMING APPARATUS

[75] Inventors: Yoshimi Nishikawa, Osaka; Keiji Murozuka; Takaji Miyazaki, both of Sagamihara, all of Japan

[73] Assignees: Daiwa Can Company, Tokyo; Shin Nippon Koki Co., Ltd., Osaka, both of Japan

[21] Appl. No.: 967,128

[22] Filed: Oct. 27, 1992

[30] Foreign Application Priority Data

Oct. 28, 1991 [JP] Japan ..... 3-308530
Nov. 13, 1991 [JP] Japan ..... 3-101423

[51] Int. Cl.[5] ..... B21D 43/06

[52] U.S. Cl. ..... 72/348; 72/361; 72/424; 72/426; 406/52; 406/94

[58] Field of Search ..... 72/344, 348, 347, 361, 72/422, 424, 426; 406/88, 94, 95, 52, 62; 198/626.1, 626.5, 626.6

[56] References Cited

U.S. PATENT DOCUMENTS

| | | | |
|---|---|---|---|
| 3,387,543 | 6/1968 | Beckers | 72/347 |
| 3,446,167 | 5/1969 | Armbruster et al. | 72/349 |
| 3,491,574 | 1/1970 | Helrigel et al. | 72/348 |
| 3,760,751 | 9/1973 | Dunn et al. | 72/348 |
| 3,800,583 | 4/1974 | Miller | 72/422 |
| 4,179,909 | 12/1979 | Maeder | 72/349 |
| 4,337,633 | 7/1982 | Logue | 72/422 |
| 4,372,143 | 2/1983 | Elert et al. | 72/349 |
| 4,534,202 | 8/1985 | Snyder | 72/349 |
| 4,685,322 | 8/1987 | Clowes | 72/348 |
| 4,696,177 | 9/1987 | Bulso et al. | 72/426 |
| 4,928,511 | 5/1990 | Sirvet | 72/424 |
| 5,122,016 | 6/1992 | Lenhart | 406/88 |

FOREIGN PATENT DOCUMENTS

| | | | |
|---|---|---|---|
| 2109728 | 6/1983 | United Kingdom | 72/347 |
| 2237763 | 5/1991 | United Kingdom . | |

*Primary Examiner*—Lowell A. Larson
*Assistant Examiner*—Thomas C. Schoeffler
*Attorney, Agent, or Firm*—Oblon, Spivak, McClelland, Maier & Neustadt

[57] ABSTRACT

A multiple lane ironing and doming apparatus for ironing and doming cup-shaped blanks into can bodies by pushing them through ironing dies by reciprocations of punches. The apparatus comprises: a plurality of punches vertically held and retained at their upper ends for vertical reciprocations; at least one ironing die unit arranged below and coaxially with each of said punches for ironing cup-shaped blanks into ironed can bodies; one doming unit arranged below the ironing die for doming the bottoms of the ironed can bodies into a predetermined configuration; stripping means for stripping the ironed and domed can bodies from the punches; and conveying means for discharging the stripped can bodies from below the punches.

15 Claims, 7 Drawing Sheets

MULTIPLE LANE IRONING AND DOMING APPARATUS

BACKGROUND OF THE INVENTION

1. Field of the Invention

The present invention relates to an apparatus for ironing and doming drawn cup-shaped blanks into drawn and ironed can bodies and, more particularly, to an ironing and doming apparatus provided with a mechanism for feeding the cup-shaped blanks successively to their working positions.

2. Description of the Prior Art

Conventionally, drawn and ironed can bodies are most commonly made, for example, by blanking and drawing a metal strip into cup-shaped blanks with a press and then redrawing and ironing the drawn cups into the can bodies by another presses in a manufacturing line. In these redrawing and ironing processes on a press, the cup-shaped blanks are pushed, one at a time, through redrawing and ironing dies and against a domer by a punch attached to a reciprocating ram and formed into such can bodies with domed bottoms all by a single stroke of the ram. Apparatuses for these ironing and doming processes are disclosed in Japanese Patent Publication No. 39516/1975, Japanese Patent Application Publication No. 184429/1985, and U.S. Pat. No. 3,446,167.

The apparatuses, as disclosed in Japanese Patent Publication No. 39516/1975 and Japanese Patent Application Publication No. 184429/1985, are so-called horizontal type ironers each having a punch mounted to an end of a horizontal ram driven back and forth by a drive means such as a crank mechanism. Provided on the way of the forward stroke of the punch and coaxially aligned therewith are a redrawing die and a number of ironing dies each having a slightly different internal diameter from one another and being arranged in the order of gradually reducing internal diameters. A stripper for stripping a shaped can body from the punch is arranged behind the last of the ironing dies. With each of these ironers, the cup-shaped blanks are placed one at a time in front of the punch in a retracted position. By moving the punch forward in this state, a cup-shaped blank placed as above is pushed at first into the redrawing die and then through the ironing dies and formed into an ironed can body. The ironed can body thus formed is stripped from the punch by the stripper on the way of a backward stroke of the punch, so that the stripped can body drops into a predetermined position and discharged.

U.S. Pat. No. 3,446,167, on the other hand, discloses a vertical type apparatus having ironing dies and domers acting as bottom shaping members both held around the arms of a rotary turret member. At the same time, punches are attached to carriers which rotate together with the rotary turret member, such that those punches are movable upward and downward relative to those ironing dies and domers. While cup-shaped blanks fed to above the ironing dies are moving together with the rotary turret member, the punches are moved downward to effect the ironing and doming processes and the shaped can bodies are taken out at discharge positions.

In the forming of drawn and ironed can bodies by the horizontal type apparatuses, the cup-shaped blank is pushed through the ironing dies and against the domer by the leading end portion of the punch, so that the punch is essentially held at its trailing end portion in the so-called "cantilever manner" by the horizontal ram. In the aforementioned horizontal type ironing and doming apparatus, therefore, the punch tends to be slightly deflected downwardly at its leading end portion by its own gravity, occasionally causing uneven thickness distribution of the ironed sidewall of the shaped can body. In order to eliminate this disadvantage, the above mentioned Japanese Patent Application Publication No. 184429/1085 discloses the unique means of tilting the ironing dies. However, such means is too sophisticated to be readily put into practical use commercially. Moreover, it is practically very difficult to design and build a horizontal type ironer having a plurality of reciprocating punches as such punches can not readily be maintained in accurate parallel relationship with each other due to the aforementioned deflections. This has been making it inevitable to provide a conventional horizontal type ironer with only one punch, one set of ironing dies and one domer. In other words, such ironer can produce only a single can body per stroke, and a number of units of such ironer have to be installed at significantly high equipment costs to achieve adequate commercial production.

In the aforementioned vertical type apparatus, the above mentioned deflections of the punches are eliminated as the punches are subjected to own gravity in their axial direction. On the other hand, however, it is extremely difficult to align the individual punches respectively with a large number of ironing dies mounted on the rotary turret member as the punches are attached to the carriers rotatably provided at the upper portions of the apparatus to rotate together with the rotary turret member and such punches are guided by guide arms and cam operated to move up and down respectively. Therefore, such apparatus essentially requires a disadvantageously complicated mechanism. Even if appropriate alignment of the punch and the dies could be accomplished, such apparatus is essentially subjected to highly localized dynamic loads concentrating on its circumference where the rotating dies move, and thus, such circumferential portions of the frame of the apparatus will have to be made rigid enough to withstand the highly localized dynamic loads to ensure operating accuracy. In any event, the aforementioned vertical apparatus having the rotary turret member has to be complicated in the construction and sizable, so that it can not readily be put into practical use or operated efficiently.

In the ironing process to manufacture drawn and ironed can bodies as so far described, cup-shaped blanks are successively conveyed to processing positions. For this purpose, U.S. Pat. No. 3,446,167 discloses a feeder comprising: a screw conveyor having spiral grooves for advancing the cup-shaped blanks; a star wheel having recesses for receiving the cup-shaped blanks from the screw conveyor; and guide members for guiding the cup-shaped blanks. In this feeder, rotations of the star wheel move the cup-shaped blanks in the recesses along the guide into predetermined positions over the ironing dies or ironing rings. Since this feeder disclosed in U.S. Pat. No. 3,446,167 has only one outlet for the supply to a plurality of the ironing rings the feeder has to move the cups at accelerated speed and stable supply of the cups cannot be ensured at all times. Also, since the cups are transferred from the screw conveyor to the star wheel and then from the star wheel to the ironing rings, a relatively complicated and sizable drive mechanism is required to operate such feeder, and therefore, it is not possible to arrange a plurality of units of such feeder closely adjacent to one another.

On the other hand, a device for supplying a horizontal type ironer with cup-shaped blanks is disclosed in Japanese Utility Model Publication No. 23076/1985. This feeding device comprises: an L-shaped guide frame for stacking a plurality of cups one above another with their axes positioned horizontally and guiding the cups at the bottom of the guide horizontally in a direction perpendicular to their axes; and a push plate disposed at the lower end corner of the guide frame and adapted to move rockingly on an axis parallel with the axes of the cups to urge the cups along the bottom of the guide horizontally and bring them one at a time into coaxial alignment with the punch. However, this device has a disadvantage in that the feed speed is essentially limited as excessively vigorous rocking movements of the push plate will give undesirably large inertial force to the cups. Also, this feeding device is applicable only to a horizontal type ironer.

SUMMARY OF THE INVENTION

An object of the present invention is to provide an ironing and doming apparatus which offers improved productivity in the manufacture of drawn and ironed can bodies by forming a number of cup-shaped blanks simultaneously into ironed and domed can bodies.

Another object of the present invention is to eliminate occurrence of defects in ironing and doming processes such as uneven sidewall thickness distribution.

Still another object of the present invention is to improve the speed of conveying cup-shaped blanks to ironing positions.

A further object of the present invention is to effect an accurate positioning of the blanks in the ironing process.

According to the present invention, there is provided a multiple lane ironing and doming apparatus for ironing and doming cup-shaped blanks by pushing them with forming punches through ironing dies, which apparatus comprises: a plurality of the forming punches arranged vertically and retained at their upper ends by and under a horizontal punch plate which is movable up and down; a plurality of ironing dies at least one each arranged below and coaxially aligned with each of said punches for ironing cup-shaped blanks into can bodies; one each of a doming unit arranged below each of the punches and the ironing dies coaxially aligned therewith for doming the bottoms of the ironed can bodies into a predetermined configuration; stripping means for stripping said ironed and domed can bodies from the lower end portions of said punches; and discharge means for discharging the stripped can bodies from below said punches. With the above arrangements of the apparatus, the individual punches are retained at their upper ends and held in a vertical position so that they can be stably held in coaxial alignment with the ironing dies without requiring any other special support means. Moreover, the individual punches are attached to the lower surface of the horizontal punch plate so that they reciprocate vertically altogether. As the cup-shaped blanks are ironed through the ironing dies and formed into can bodies, they are held closely fitted to the punches. These ironed can bodies, after domed at the bottoms, are stripped from the punches by the stripping means at the ascending stroke of the punches and discharged by the discharge means from below the dies to predetermined portions. A series of these forming processes are simultaneously performed by the plurality of punches in conjunction with the ironing dies and doming units so that a number of finished can bodies can be produced by a single stroke of the horizontal punch plate.

Moreover, a plurality of feeders for feeding the cup-shaped blankes to above the ironing dies are arranged to extend horizontally to positions where the punches reciprocate and such feeders each comprise: a cup guide arranged to guide said cup-shaped blanks in a row with their open ends directed upwardly to a position where one of said punches moves up and down; positioning blocks disposed at the leading end of said cup guide for positioning each of said cup-shaped blanks one at a time in coaxial alignment with the above mentioned punch while being in close contact with the outer circumference of said cup-shaped blank; an opening formed below said cup-shaped blank which is in contact with said positioning blocks, for passing said blank therethrough; and a single-cup take up rotating member or turret arranged in the vicinity of the leading end of said cup guide for picking up the first one of said cup-shaped blanks in a row, at a time, separately from the rest of the blanks in the row, forwarding and bringing said first blank into close contact with said positioning blocks and holding back the succeeding cup-shaped blanks. With these arrangements of the feeders, the cup-shaped blanks are fed successively at a high speed to below the respective punches by the rotations of the single-cup take up rotating members or turrets.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
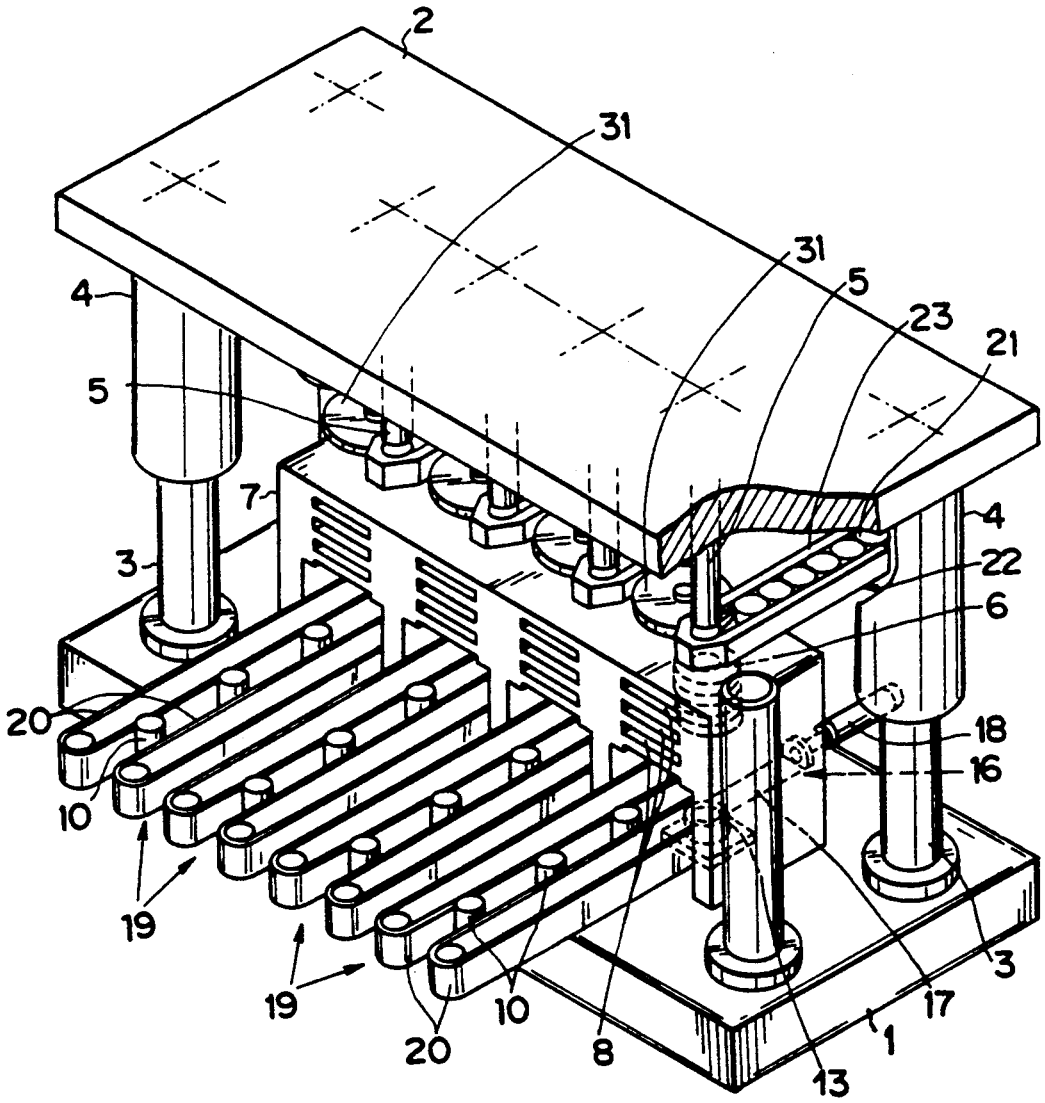
FIG. 1 is a partially cut-away perspective view showing one embodiment of the present invention.

The present invention will be described in the following in connection with an embodiment thereof with reference to the accompanying drawings. FIG. 1 is a partially cut-away perspective view showing one embodiment of the present invention, in which a vertical ironing and doming apparatus is constructed in a four-lane configuration. Specifically, a die plate 1 and a punch plate 2 both having substantially rectangular surfaces are arranged horizontally and in parallel to face each other as a set. The punch plate 2 carries on its lower surface four sleeves 4 each slidably engaged with each guide post 3 extending vertically upwardly from each corner of the upper surface of the die plate 1, so that the punch plate 2 is guided by the guide posts 3 to move up and down reciprocally while maintaining its parallel relationship with the die plate. Retained vertically and downwardly by the lower surface of the punch plate 2, four forming punches 5 are arranged in a row centered transversely thereto.

Figure 2:
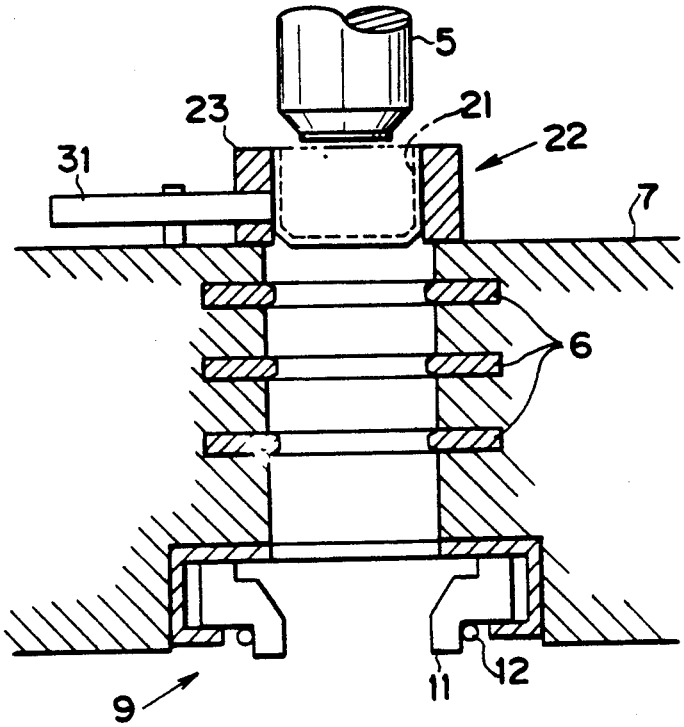
FIG. 2 is a section showing the arrangement of an ironing dies for each punch.
Figure 2:
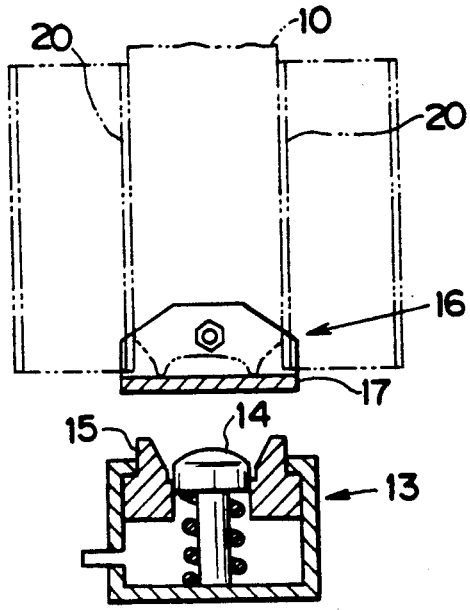

On the central portion of the upper surface of the die plate 1, on the other hand, there is arranged a gantry-like die holder 7 for holding four sets of ironing dies 6, each set comprising three ironing dies 6 held in coaxial alignment with one another for each punch 5. Like those of the prior art, three annular ironing dies 6 of different internal diameters are arranged as a set in the order of gradually decreasing internal diameters and are inserted in slits 8 which are formed horizontally in the die holder 7, such that each set of the ironing dies 6 are coaxially aligned with and held below one of the punch 5. FIG. 2 is a section view showing the arrangements of one of the sets of the ironing dies 6 and one of the punches 5 coaxially aligned therewith.

Figure 3:
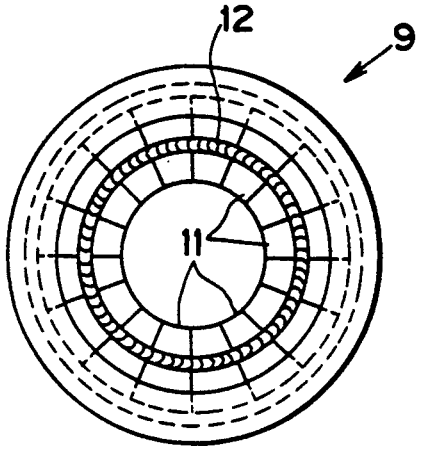
FIG. 3 is a bottom view of a stripper.

Mounted below each set of ironing dies 6 is a can body removing means or stripper assembly 9 provided for removing a finished can body e.g., an ironed and domed can body 10 from the punch 5 coaxially aligned with the set of ironing dies 6. As shown in FIGS. 2 and 3, the stripper assembly 9 comprises a plurality of finger members 11 which are assembled as an expandable ring and loaded radially inwardly by a spring 12, so that the minimum internal diameter of the ring of the assembled finger means 11 is slightly smaller than the external diameter of the aforementioned punch 5.

On the upper surface of the aforementioned die plate 1 and at the bottom dead point of the reciprocal movement of each punch 5, there is arranged a bottom shaping unit or a doming unit 13 positioned in coaxial alignment with the punch. This doming unit 13 is provided for shaping the central portion of the bottom surface of ironed can bodies into an inwardly domed configuration. This doming unit 13 comprises a doming die 14 having a substantially domed upper surface projecting upwardly, and a doming sleeve 15 having a counter-tapered annular ring portion disposed around the doming die 14. When the punch 5 moves downward to push an ironed can body against the doming unit 13, the doming sleeve 15 is pushed back downwardly below the doming die 14 so that the central portion of the bottom surface of the ironed can body is domed inwardly by the doming die 14.

Slightly above each doming unit 13, there is arranged a receiving unit 16 for receiving a finished can body 10 which is stripped from the punch 5 by the stripper assembly 9. Although only one receiving unit 16 is shown in FIG. 2, similar receiving units are arranged for all four punches 5. Each receiving unit 16 is constructed such that a plate member 17 extending at a right angle with respect to the row of the punches 5 is moved back and forth by a driving means such as an air cylinder 18. The reciprocations of the plate member 17 are so timed with the vertical movements of the corresponding punch 5 as to invite no interference. It should be readily appreciable that the air cylinder 18 can be replaced by a mechanical actuator which is operated in timed relation with the vertical movements of the punch 5 by taking such movements and converting them into horizontal motions to actuate the plate member 17, and such mechanical actuator may perform more preferably in terms of accuracy of timing.

Above each doming unit 13 and in the vicinity of each receiving unit 16 there is arranged a discharge belt conveyor 19. The discharge belt conveyor 19 is provided for picking up and discharging a finished can body 10 received upright on the aforementioned plate member 17. The conveyor 19 comprises a pair of endless flat belts 20 which hold the finished can body 10 in an upright position therebetween and discharge it out of the ironing and doming apparatus.

Figure 4:
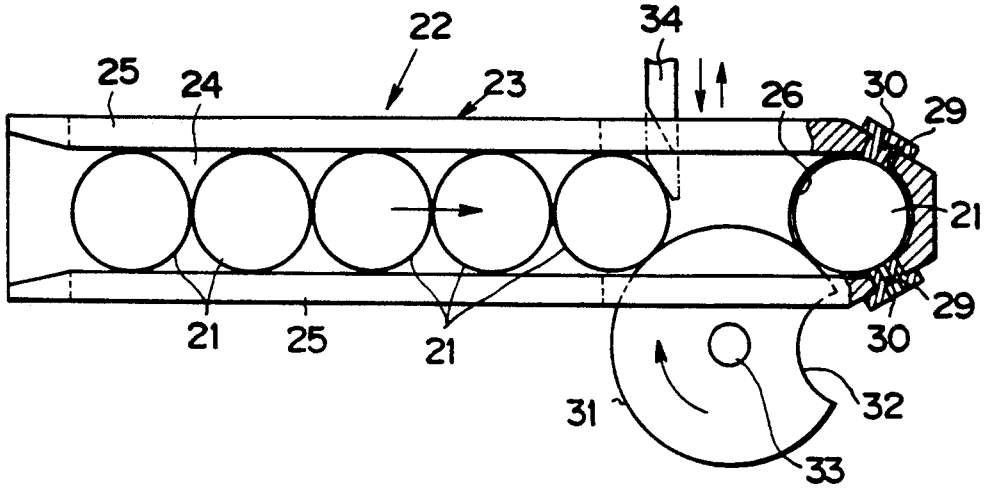
FIG. 4 is a partially broken top plan view showing one example of a feeder.
Figure 5:
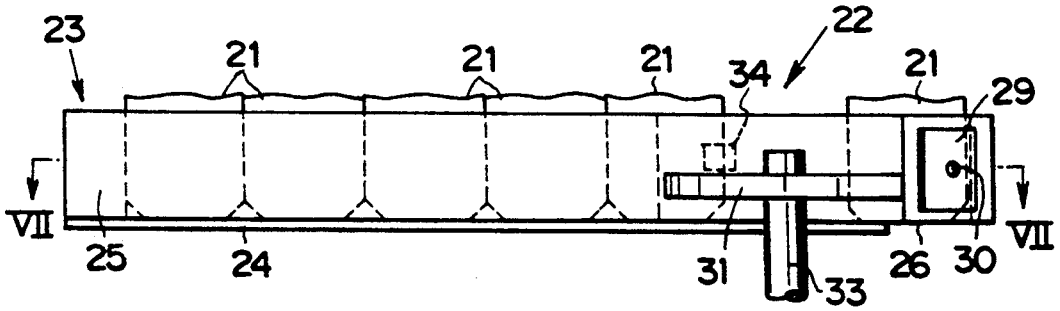
FIG. 5 is a side elevation showing the feeder.

Provided further on the upper surface of the aforementioned die holder 7 are feeders 22 each delivering cup-shaped blanks or cups 21 one after another to just below one of the punches 5. As shown in FIGS. 4 and 5, each feeder 22 has a cup guide 23 for guiding the cups 21 in a row. The cup guide 23 comprises a bottom guide 24 for supporting the cups 21 with their open ends up and a pair of side guides 25 for restricting sideway movements of the cups 21.

Figure 7:
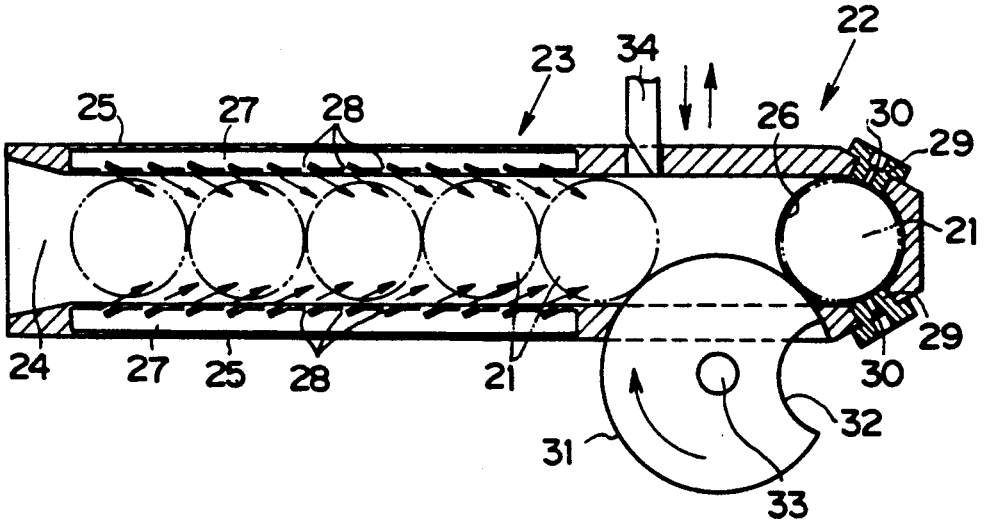
FIG. 7 is a section taken along line VII—VII of FIG. 5.

A pair of the side guides 25 join each other at their leading end portions so that an advancing cup 21 comes to stop against the juncture thereof. Underneath the juncture of the side guides 25 where a cup 21 comes to stop thereagainst, the bottom guide 24 has an opening 26 which is slightly larger in diameter than the external diameter of the cup 21. The side guides 25 are of a partly hollow chamber construction as shown in FIG. 7 and hollow chambers 27 each extend within a predetermined range from the trailing end portion to the intermediate portion of each side guide 25. These chambers 27 have a number of injection ports 28 provided in their inner walls facing each other, in such manner that a pressurized fluid is directed from the ports 28 obliquely forwardly to push the cups 21 toward the leading end of the cup guide 23. The fluid thus directed may be air or a coolant or lubricant used in the ironing process.

Attached to the leading end of the aforementioned cup guide 23 are a pair of positioning blocks 29. These positioning blocks 29 are provided for positioning the outer circumference of a cup 21 thereagainst to coaxially align the cup 21 with the aforementioned punch 5. The positioning blocks are adjustably mounted on the cup guide 23 so that the amount of inward protrusion of the blocks from the side guides 25 can be adjusted, as necessary. The cup-contacting faces of the positioning blocks 29 have a curvature substantially equal to that of the outer circumference of the cup 21 so as to come to close contact with the cup 21. Formed in the cup contacting face of each positioning block 29 is a suction port 30 for sucking and holding cup 21 in position. This suction port 30 is not indispensable but may be omitted particularly when a liquid is used as the pressurized fluid for pushing the cup 21 and adequate suction effect cannot be expected. On the way to and in the proximity of the leading end of the cup guide 23, there is arranged a single-cup take-up rotating member or turret 31. This turret 31 has a pocket 32 which is cut as an arcuate recess in its outer circumferential portion to pick up and receive a cup 21 therein at a time. The turret 31 is mounted on a spindle 33 installed outside of the cup guide 23 in such manner that portions of the turret 31 protrude inwardly through one of the side guides 25 and, as the turret 31 rotates, the pocket 32 runs above the path of the cup 21 of the cup guide 23. The turret 31 is sized to such diameter that its periphery just clears the cup 21 which is held in contact with the aforementioned positioning blocks 29, thereby preventing the cup 21 from bouncing back from blocks 29 and assisting positioning the cup 21 stably against the positioning blocks 29. However, when positioning blocks 29 not provided with suction ports 30 are in use, the turret 31 should preferably be positioned such that its outer circumference comes in light contact with the cup 21 located against the positioning blocks 29. The turret 31 arranged as above rotates one full turn in synchronism with each full stroke of upward and downward movements of the aforementioned punch 5.

Figure 8:
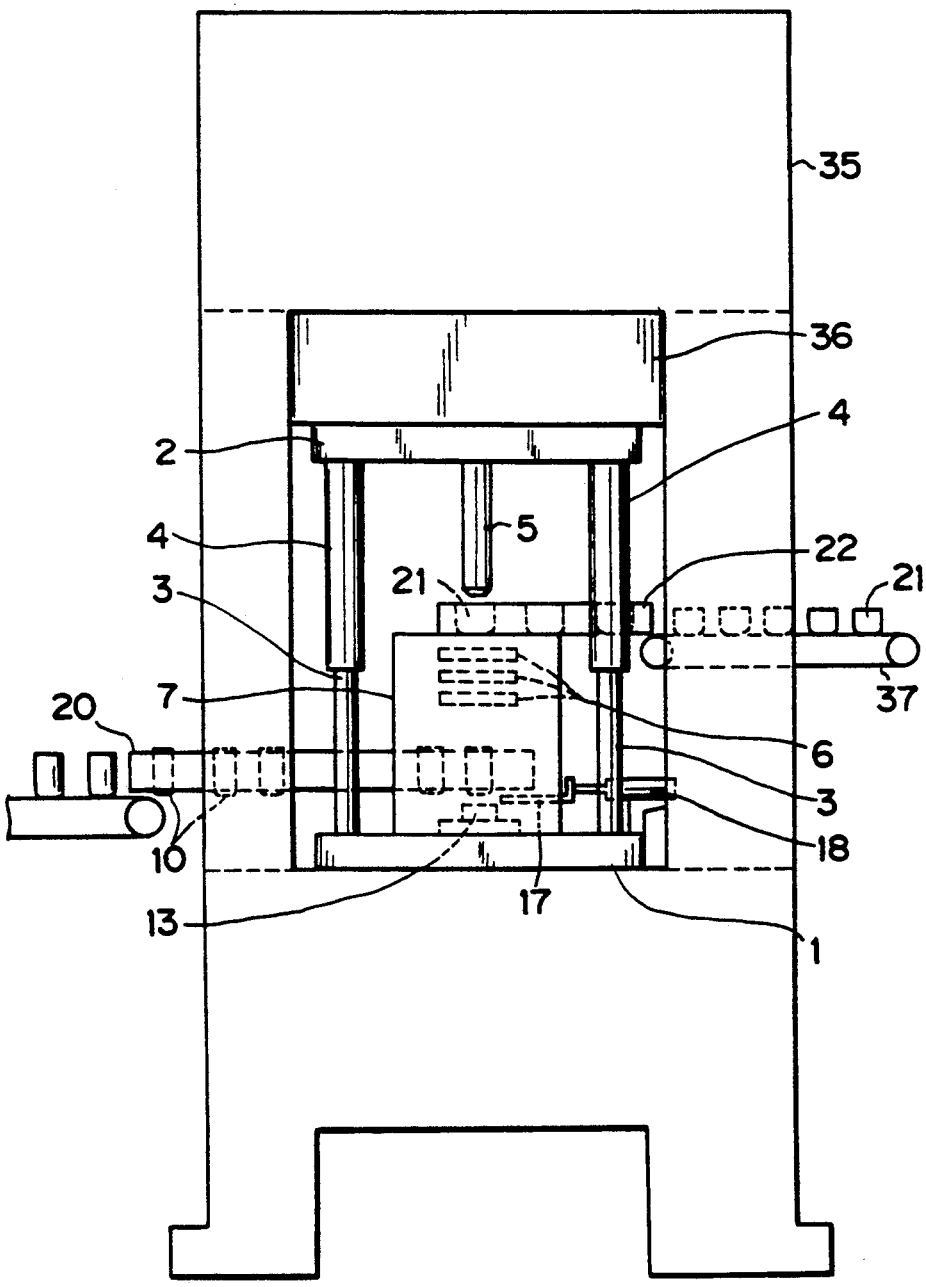
FIG. 8 is a schematic diagram showing the state in which ironing and doming processes are being performed.

As the turret 31 described above is protruded inwardly of the cup guide 23, it acts as a stopper to hold back the cups 21 upstream by its circular periphery. However, since the turret 31 rotates in synchronism with the vertical movements of the punch 5, the turret 31 may rotate and pocket 32 may pick up and send a cup 21 forward to below the punch even during idling strokes of the punch 5 for, say, warming up before production runs. In order to eliminate this disadvantage, the feeder of this embodiment is equipped with a stopper finger 34 as shown. The stopper finger 34 moves in and out of the way through the side guide 25 facing the other through which the turret 31 is protruded inwardly, and when the finger 34 moves in, it positively holds back the cup 21 being in contact with the circular periphery of the turret 31 and restricted to move forward. Next, the operations of the ironing and doming apparatus thus constructed will be described. As shown in FIG. 8, the ironing and doming apparatus is set in a press 35 having a slide 36, to which the punch plate 2 is attached. The feeders 22 are arranged on the upper surface of the die holder 7 and their cup guides 23 each are arranged such that the respective cups 21 held by each pair of positioning blocks 29 are coaxially aligned with the respective punches 5, and the trailing end portions of the respective cup guides 23 extend to the leading end portion of a belt conveyor 37 located behind the ironing and doming apparatus.

Figure 9:
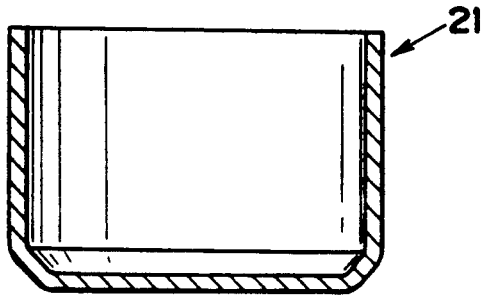
FIG. 9 is a section showing a cup or cup-shaped blank to be formed into a can body.

The cups 21 are drawn cup-shaped blanks as shown in FIG. 9, formed by blanking and drawing a metal strip. The cups 21 are fed in an upright position with their open ends up in a row into each cup guide 23 by the belt conveyor 37 shown in FIG. 8. Received by the cup guide 23, the cups 21 are carried forward by the fluid which is jetted under pressure through the injection ports 28 formed in the side guides 25. While the individual cups 21 are in sliding contact with the upper surface of bottom guide 24, they move forward smoothly without getting damaged because they are wetted or lubricated by the coolant which was used in the preceding drawing process. If a coolant is jetted from the injection ports 28, it acts as a lubricant to further enhance smooth movements of the cups 21.

When the aforementioned stopper finger 34 stays projected into the inside of the cup guide 23 it traps the cups moving forward in a row in the cup guide 23, so that the cups come in contact with one another under the pressure of the fluid directed thereagainst. Unlike conventional conveyors, however, the trapped cups 21 are subjected only to the propelling force created by the fluid and the bottom guide 24 is stationary so that the cups 21 are free from getting scratched or suffering other adverse effects of the trapping possible with the conventional conveyors. Therefore, the press can be warmed up with the cups in the cup guide 23 without causing damage thereto.

Figure 6:
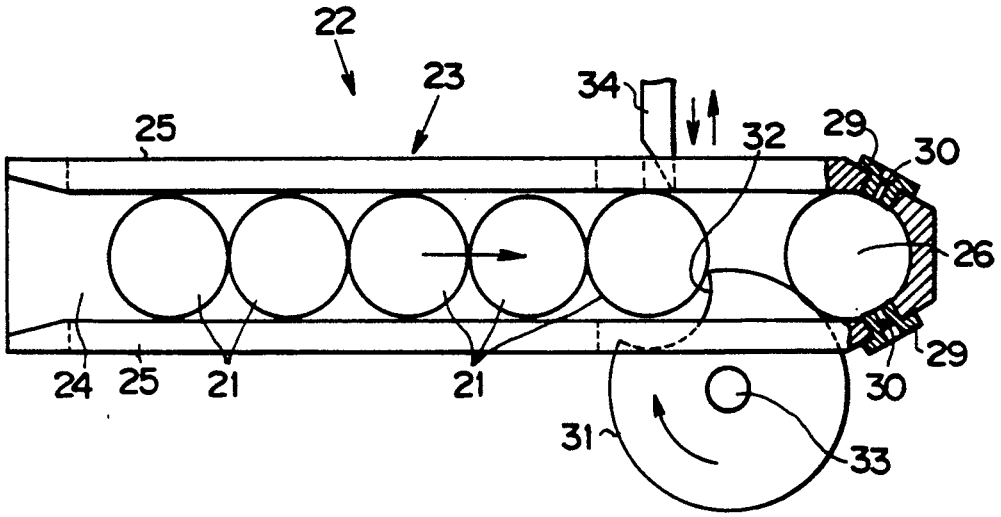
FIG. 6 is a top plan view similar to FIG. 4 but shows the state in which a single-cup take-up turret further rotates from the position in FIG. 4.

When the stopper finger 34 is retracted out of the way, on the other hand, the first one of the cups 21 in a row in the cup guide 23 comes into abutment and is held back momentarily against the outer circumference of the aforementioned turret 31. As the turret 31 continues rotating, in the direction of the arrow as shown, in synchronism with the vertical movements of the punch 5 and just when the pocket 32 enters the cup guide 23, the first cup 21 is received by the pocket 32, as shown in FIG. 6. When the first cup 21 has been received in the pocket 32 completely, the turret 31 moves the cup in the pocket toward the leading end position of the cup guide 23 while the succeeding cup 21 is held back against the outer circumference of the turret 31 as the pocket 32 is sized to receive just one cup 21. Thus, the turret 31 separates just the first cup from the subsequent cups 21 at a time and brings it forward.

As the turret 31 further rotates and the pocket 32 moves out of the cup guide 23, the cup 21 in the pocket 32 is released into the leading end position of the cup guide 23 and comes into contact with the positioning blocks 29. FIG. 4 shows a cup 21 which has been thus fed to the leading end position of the cup guide 23. When the pocket 32 has moved out of the cup guide 23, the outer circumferential portions of the turret 31 continuing from the pocket 32 protrudes into the cup guide 23 and prevents the cup 21 at the leading end portion of the cup guide 23 from bouncing back even if it bumps against the positioning blocks 29.

The cup thus fed to the leading end position of the cup guide 23 is sucked by the positioning blocks 29 disposed therein and held above the aforementioned opening 26 in coaxial alignment with the punch 5.

While the cups are held in the positions above the openings 26, the slide 36 moves downward so that the individual punches 5 retained by the punch plate 2 mounted to the slide come into contact with and push the respective cups 21 through the respective sets of the ironing dies 6. Three ironing dies 6 each having a slightly different internal diameter from one another are used as a set in this embodiment and these ironing dies are arranged in coaxial alignment with one another and in the order of decreasing internal diameters, so that as a cup 21 passes through those ironing dies 6, its sidewall is thinned and stretched gradually in the axial direction. Since each individual punch 5 is vertically retained at its upper end by the punch plate 2, it is free from any sideway deflection and maintained in coaxial alignment at all times with the corresponding set of the ironing dies 6, so that the cup 21 is accurately centered to the respective ironing dies 6 and formed into an ironed can body having uniform thickness around its sidewall.

Figure 10:
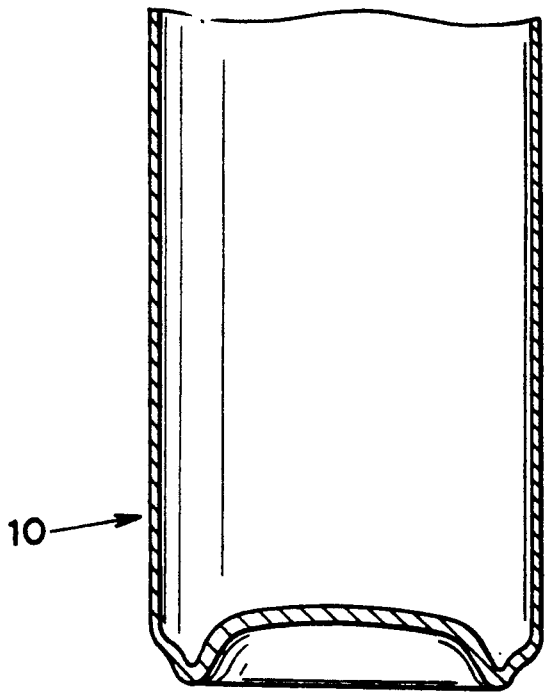
FIG. 10 is a section showing an ironed and domed can body.

After the ironed can body formed as above leaves the ironing dies 6, the punch 5 further pushes it downward expanding the ring of the finger members 11 of the stripper assembly 9. During this downward stroke of the punch 5, the plate member 17 stays in a retracted position to clear the way of the punch 5 so that the ironed can body is allowed to move past the space between the pair of belts 20 of the belt conveyor 19 until it bottoms on the doming unit 13. In this doming unit 13, the doming sleeve 15 is moved downwards relative to the doming die 14 by the punch 5 so that the bottom of the ironed can body is domed inwardly as shown in FIG. 10.

When the punch 5 is at the bottom of its downward stroke, the ironed and domed can body or finished can body 10 remains closely fitted to the punch 5 and is positioned past and below the stripper 9, so that the ring of the finger members 11 of stripper 9 is urged into direct contact with the punch 5. On the way of the upward stroke of the punch 5, therefore, the edge at the open end of the finished can body 10 is trapped by the finger members 11 of the stripper assembly 9 and as the punch 5 further moves upwards, the finished can body 10 is removed therefrom. At this time, compressed air is jetted from the leading end of the punch 5 to assist the removal of the finished can body 10. By the time that the finished can body 10 is completely removed from the punch, the aforementioned plate member 17 is moved forward by the air cylinder 18 to the position below the punch 5, so that the finished can body 10 removed from the punch 5 is received by the plate member 17 and placed thereon in an upright position. Then, the finished can body 10 on the plate member 17 is taken out from below the punch 5 while being held at its ironed sidewall between the pair of the endless belts 20.

After a cup is formed into a finished can body in this manner and by the time that the punch 5 ascends to its top dead stroke and starts descending again, the turret 31 rotates as described above so that the next cup 21 is fed to and held by the positioning blocks 29.

The ironing process thus far described is accomplished simultaneously and similarly for the four punches 5 so that four finished can bodies 10 can be produced at a time by a single vertical movement of the punch plate 2 or the slide 36 of the press 35. The number of the finished can bodies obtainable per stroke of the punch plate 2 or the slide 36 can be increased, depending upon a number of the punches 5 to be attached to the punch plate 2 and corresponding ironing dies 6 and doming units 13 used.

Incidentally, the three ironing dies 13 were used as a set in the embodiment thus far described, but the number of ironing dies 13 used as a set for one punch 5 should not be limited to three, but other number of ironing dies can be used as a set, if necessary.

Also, the aforementioned embodiment is constructed such that the cups move in sliding contact with the bottom guide of the cup guide. However, the cups may be floated and advanced by jets of a pressurized fluid directed obliquely upwardly from the bottom guide.

Furthermore, the individual positioning blocks 29 in the aforementioned embodiment are provided with the suction ports 30 to suck the cups 21, but these suction ports 30 may be omitted since it has been revealed by the inventors' experiments that the accurate positioning of the cups 21 can be achieved without such suction means.

Furthermore, the single-cup take-up rotating member used in accordance with the present invention has been exemplified by the turret which has a pocket formed in one portion of its outer circumference. However, the present invention should not be limited to the aforementioned embodiment, and the single-cup take-up rotating member of the invention may be of any other form so far as it can separate the first cup from the remaining ones in a row and forward it by rotations thereof.

An overall advantage of a multiple lane ironing and doming apparatus according to the present invention is in improved productivity in the manufacture of drawn and ironed can bodies achievable by forming a plurality of such can bodies simultaneously with a single stroke of a press using a plurality of vertically mounted punches retained at their upper ends by a vertically movable horizontal punch plate and corresponding numbers of sets of ironing dies.

Moreover, since the individual punches and the corresponding ironing dies of an ironing and doming apparatus of the present invention can be positioned accurately in coaxial alignment with each other and moved up and down without any sideway deflection, ironing defects such as uneven thickness distribution of ironed walls can be eliminated. Also, the feeder of an ironing and doming apparatus according to the present invention is not only capable of supplying cup-shaped blanks successively but accurate delivery of such blanks is possible because the feeder is constructed such that the cup-shaped blanks arrayed in a row are picked up one at a time and fed by rotations of the single-cup take-up rotating member and no transfer of the blanks from a mechanism to another nor reciprocal movement is involved therein.

What is claimed is:

1. A multiple lane ironing and doming apparatus for ironing and doming cup-shaped blanks by pushing them through ironing dies and against doming dies utilizing reciprocating punches, comprising:

a plurality of simultaneously reciprocating punches each held vertically and retained at its upper end by a supporting means for vertically reciprocating said plurality of punches simultaneously;

a plurality of inlet feeders, each associated with one of said plurality of punches, for supplying cup-shaped blanks to be punched by said plurality of punches;

a plurality of ironing dies, arranged at least one each under and in coaxial alignment with each of said punches for ironing cup-shaped blanks into ironed can bodies;

a plurality of doming units, provided one each below and in coaxial alignment with each of said punches and said ironing dies for doming the bottoms of the ironed can bodies into a predetermined configuration;

a stripping means located below each of said punches when said punches are at a topmost position, said stripping means located below said ironing dies and above said doming units for stripping ironed and domed can bodies from said punches; and a plurality of discharge conveyors, each associated with one of said plurality of punches, for discharging the stripped can bodies from a location below said punches.

2. A multiple lane ironing and doming apparatus according to claim 1, further comprising:

a horizontal plate retaining said punches on its lower surface; and a plurality of guide posts for guiding said plate vertically while housing said plate in a horizontal position.

3. A multiple lane ironing and doming apparatus according to claim 1, wherein a number of said ironing dies having different internal diameters are arranged in coaxial alignment with each of said punches such that the ironing die having a larger internal diameter is positioned above another having a smaller internal diameter.

4. A multiple lane ironing and doming apparatus according to claim 3, further comprising:

a die holder having horizontal slits for individually receiving and holding said ironing dies therein in coaxial alignment with the respective punches.

5. A multiple lane ironing and doming apparatus according to claim 1, wherein said stripping means comprises a plurality of finger members assembled into a plurality of expandable rings, each loaded by an elastic member radially inwardly to have an internal diameter a little smaller than the outside diameter of the punches and arranged in coaxial alignment with one of the punches such that the rings are expanded radially outwardly when the assembled finger members are pushed out by a descending movement of the respective punches.

6. A multiple lane ironing and doming apparatus according to claim 1, wherein each of said doming units comprises: an annular doming sleeve having its inner upper wall tapered to extend from its top portion downwardly and radially inwardly; and a doming die having a substantially domed upper surface projecting upwardly and being arranged to be loaded upwardly by an elastic member in the central portion of said doming sleeve.

7. A multiple lane ironing and doming apparatus according to claim 1, wherein said plurality of discharge conveyors each include a pair of endless flat belts, each pair of endless flat belts being arranged facing and spaced from each other and adapted to convey the ironed and domed can bodies therebetween.

8. A multiple lane ironing and doming apparatus according to claim 1, further comprising a plurality of receiving units each arranged to be movable back and fourth horizontally between the stripping means and one of the doming units is timed relationship with the reciprocations of the punch coaxially aligned with said doming die to receive the ironed and domed can body stripped from said punch by said stripping means and to have it discharged by a respective one of said plurality of discharge conveyors.

9. A multiple lane ironing and doming apparatus according to claim 8, wherein said receiving units comprise: a plurality of linear actuators each arranged at the side opposite to said plurality of discharge conveyors about each of the punches; and a plurality of plate members each moved back and forth horizontally by one of said actuators to receive the ironed and domed can body.

10. A multiple lane ironing and doming apparatus according to claim 1, wherein said plurality of inlet feeders are disposed to extend substantially horizontally for conveying the cup-shaped blanks one after another successively with their open ends directed upwards to above the ironing dies coaxially aligned with one of the punches while said punch is on its upward stroke of the reciprocations clearing said ironing dies.

11. A multiple lane ironing and doming apparatus according to claim 10, wherein said feeders each comprise:

a cup guide arranged to extend substantially horizontally to a path of one of the punches and array the cup-shaped blanks in a row with their open ends directed upward;

positioning blocks disposed at the leading end of said cup guide for receiving said cup-shaped blanks, one at a time, with their outer circumferences closely contacting said blocks and positioning said cup-shaped blanks one after another in coaxial alignment with the punch;

an opening formed below the cup-shaped blank positioned by said positioning blocks, for passing the blank therethrough; and a single-cup take-up rotating member arranged rotatably in the vicinity of the leading end of said cup guide for separating the first cup-shaped blank from the rest of cup-shaped blanks in the row at a time and bringing said first blank into close contact with said positioning blocks while trapping the rest of the cup-shaped blanks in the row.

12. A multiple lane ironing and doming apparatus according to claim 11, wherein said cup guide has injection ports for jetting a fluid in a direction to urge the cup-shaped blanks arrayed in a row toward said leading end of said cup guide.

13. A multiple lane ironing and doming apparatus according to claim 11, wherein said positioning blocks have at least one suction port for sucking and holding said cup-shaped blanks, one at a time.

14. A multiple lane ironing and doming apparatus according to claim 11, wherein said single-cup take-up rotating member has a pocket or a recess formed in its outer circumference for receiving said cup-shaped blanks, one at a time, said pocket or recess passing above a path of said cup-shaped blanks in the cup guide.

15. The multiple lane ironing and doming apparatus of claim 1, wherein said inlet feeders each include a plurality of fluid openings which direct a fluid against side surfaces of said cup-shaped blanks to urge said cup-shaped blanks toward a forward end of each of said feeders.

* * * * *

UNITED STATES PATENT AND TRADEMARK OFFICE

CERTIFICATE OF CORRECTION

PATENT NO. : 5,301,534

DATED : April 12, 1994

INVENTOR(S) : Yoshimi Nishikawa, et al

It is certified that error appears in the above-indentified patent and that said Letters Patent is hereby corrected as shown below:

Column 10, line 49, change "housing" to --holding--.
Column 11, line 39, change "is" to --in--.

Signed and Sealed this

Second Day of August, 1994

*Attest:*

Bruce Lehman

BRUCE LEHMAN

*Attesting Officer*

*Commissioner of Patents and Trademarks*